United States Patent [19]

Folkins

[11] Patent Number: 4,851,884

[45] Date of Patent: Jul. 25, 1989

[54] PIECEWISE DEVELOPMENT SYSTEM

[75] Inventor: Jeffrey J. Folkins, Rochester, N.Y.

[73] Assignee: Xerox Corporation, Stamford, Conn.

[21] Appl. No.: 167,947

[22] Filed: Mar. 14, 1988

[51] Int. Cl.[4] ..... G03G 15/08

[52] U.S. Cl. ..... 355/246; 355/251; 355/260; 355/261

[58] Field of Search ..... 355/3 DD, 14 D, 3 R, 355/38 E; 430/120; 118/651, 661

[56] References Cited

U.S. PATENT DOCUMENTS

| | | | |
|---|---|---|---|
| 4,482,243 | 11/1984 | Suzuki et al. | 355/14 D |
| 4,533,234 | 8/1985 | Watai et al. | 355/14 D |
| 4,553,827 | 11/1985 | Mayer | 355/3 DD |
| 4,591,261 | 5/1986 | Saruwatari et al. | 355/4 |
| 4,603,961 | 8/1986 | Folkins | 355/3 DD |
| 4,652,113 | 3/1987 | Watanabe | 355/3 DD |
| 5,537,494 | 8/1985 | Lubinsky et al. | 355/3 DD |

*Primary Examiner*—A. C. Prescott

*Attorney, Agent, or Firm*—H. Fleischer; J. E. Beck; R. Zibelli

[57] ABSTRACT

An apparatus which develops a latent image, corresponding to an original document, recorded on a moving member. The apparatus includes a first developer unit and a second developer having their characteristics regulated so that the density of the developer material deposited on the latent image by the second developer unit approximates that of the original document over a first density region of the original document. The density of the developer material deposited on the latent image by the second developer unit or both the first developer unit and the second developer unit approximates that of the original document over a second density region.

20 Claims, 4 Drawing Sheets

PIECEWISE DEVELOPMENT SYSTEM

This invention relates generally to an electrophotographic printing machine, and more particularly concerns an apparatus for developing a latent image recorded on a photoconductive member.

Generally, the process of electrophotographic printing includes charing a photoconductive member to a substantially uniform potential to sensitize the surface thereof. The charged portion of the photoconductive surface is exposed to a light image of an original document being reproduced. This records an electrostatic latent image on the photoconductive member corresponding to the informational areas contained within an original document. After the electrostatic latent image is recorded on the photoconductive member, the latent image is developed by bringing a developer material into contact therewith. This forms a toner powder image on the photoconductive member which is subsequently transferred to a copy sheet. Finally, the powder image is heated to permanently affix it to the copy sheet in image configuration.

A suitable developer material may comprise carrier granules having toner particles adhering triboelectrically thereto. This two component mixture if brought into contact with the electrostatic latent image recorded on the photoconductive surface. Toner particles are attracted from the carrier granules to the latent image. These toner particles adhere to the latent image to form a powder image on the photoconductive surface.

In electrophotographic printing, the overall objective is to maintain the ratio of the input density of the original document to the output density of the copy substantially linear. However, in an electrophotographic printing machine, a graph of input density of the original document versus the output density of the copy is generally curved concavely. This is not a problem in normal high contrast electrophotographic printing where a curve of the output density of the copy versus the input density of the original document having a high slope is actually desirable. It is, however, important to have the slope of the curve of the output density of the copy versus the input density of the original document substantially equal to or close to one when reproducing continuous tone or color original documents. Unfortunately, because of the shape of the photoinduced discharge curve of the photoreceptor in most electrophotographic printing machines, as well as the fact that, generally, the printing machines have development systems which either have a linear developed mass versus potential curve, or worse yet a concave down mass versus potential curve, the density output versus input response is mostly concave. Hereinbefore, systems modeling and testing have been unable to find system parameters which provide a linear ratio of the input density of the original document to the output density of the copy over a sufficiently wide range of input density of the original document. It is, thus, clear that it is highly advantageous to construct a development system which will compensate for the nonlinearities of other subsystems and, thus, will linearize the ratio of the input density of the original document to the output density of the copy over a wide range of input density of the original document. Various systems have been devised for improving development. The following disclosures appear to be relevant:

U.S. Pat. No. 4,537,494

Patentee: Lubinsky et al.
Issued: Aug. 27, 1985
U.S. Pat. No. 4,591,261
Patentee: Saruwatari et al.
Issued: May 27, 1986
U.S. Pat. No. 4,603,961
Patentee: Folkins
Issued: Aug. 5, 1986
U.S. Pat. No. 4,652,113
Patentee: Wantanabe
Issued: Mar. 24, 1987

The relevant portions of the foregoing patents may be briefly summarized as follows:

U.S. Pat. No. 4,537,494 discloses a multi-roll development system including a plurality of developer rollers having a photoconductive belt wrapped around at least a portion of the first two rollers. More specifically, the development system employs three developer rolls 40, 42 and 44. As stated in column 7, lines 18 through 25, inclusive, tubular member 90 of roll 40 and tubular member 94 or roll 42 are both electrically biased by voltage sources to a suitable polarity and magnitude. The voltage level is intermediate that of the background voltage level and the image voltage level recorded on the photoreceptor. Tubular member 90 and tubular member 94 may be electrically biased to different voltage levels ranging from about 50 volts to about 350 volts. Column 9, lines 12 through 19, inclusive, state that by way of example, the voltage source electrically biases tubular member 114 to a voltage ranging from about 50 volts to about 350 volts. The electrical bias applied to tubular member 114 does not necessarily have to be of the same magnitude as the electrical bias applied to the respective tubular members of developer rollers 40 and 42.

U.S. Pat. No. 4,591,261 describes a development system having two developer rollers which rotate at different speeds relative to one another. The developer rollers may be used to transport red and black developer material, respectively, or the same color developer material with each developer roller transporting different particle size developer material.

U.S. Pat. No. 4,603,961 discloses a controller which regulates the voltage output from a voltage source electrically connected to three developer rollers as a function of the sensed photoreceptor voltage. A fourth developer roller is coupled to another voltage source and electrically biased to a fixed voltage level.

U.S. Pat. No. 4,652,113 describes four developer units. Each developer unit is adapted to develop an electrostatic latent image recorded on a photoreceptor with a different color developer material.

In accordance with one aspect of the present invention, there is provided an apparatus for developing a latent image, corresponding to an original document, recorded on a moving member. The apparatus includes a first developer unit, positioned closely adjacent the member, for transporting developer material to the latent image. A second developer unit is positioned adjacent the member, after the first developer unit in the direction of movement of the member, for transporting developer material to the latent image. Means are provided for regulating the characteristics of the first developer unit and the second developer unit so that the density of the developer material deposited on the latent image by the second developer unit approximates that of the original document over a first density region of the original document, and that the density of the developer material deposited on the latent image by the first developer unit or both the first and second developer units approximates that of the original document over a second density region.

Pursuant to another aspect of the present invention, there is provided an electrophotographic printing machine of the type in which an electrostatic latent image, corresponding to an original document, is recorded on a moving photoconductive member. The printing machine includes a first developer unit, positioned closely adjacent the photoconductive member, for transporting developer material to the electrostatic latent image. A second developer unit is positioned adjacent the photoconductive member, after the first developer unit in the direction of movement of the photoconductive member, for transporting developer material to the electrostatic latent image. Means are provided for regulating the characteristics of the first developer unit and the second developer unit so that the density of the developer material deposited on the electrostatic latent image by the second developer unit approximates that of the original document over a first density region of the original document, and that the density of the developer material deposited on the electrostatic latent image by the first developer unit or both the first and second developer units approximates that of the original document over a second density region.

Other aspects of the present invention will become apparent as the following description proceeds and upon reference to the drawings, in which.

While the present invention will hereinafter be disclosed in connection with a preferred embodiment thereof, it will be understood that it is not intended to limit the invention to that embodiment. On the contrary, it is intended to cover all alternatives, modifications, and equivalents as may be included within the spirit and scope of invention as defined by the appended claims.

Figure 1:
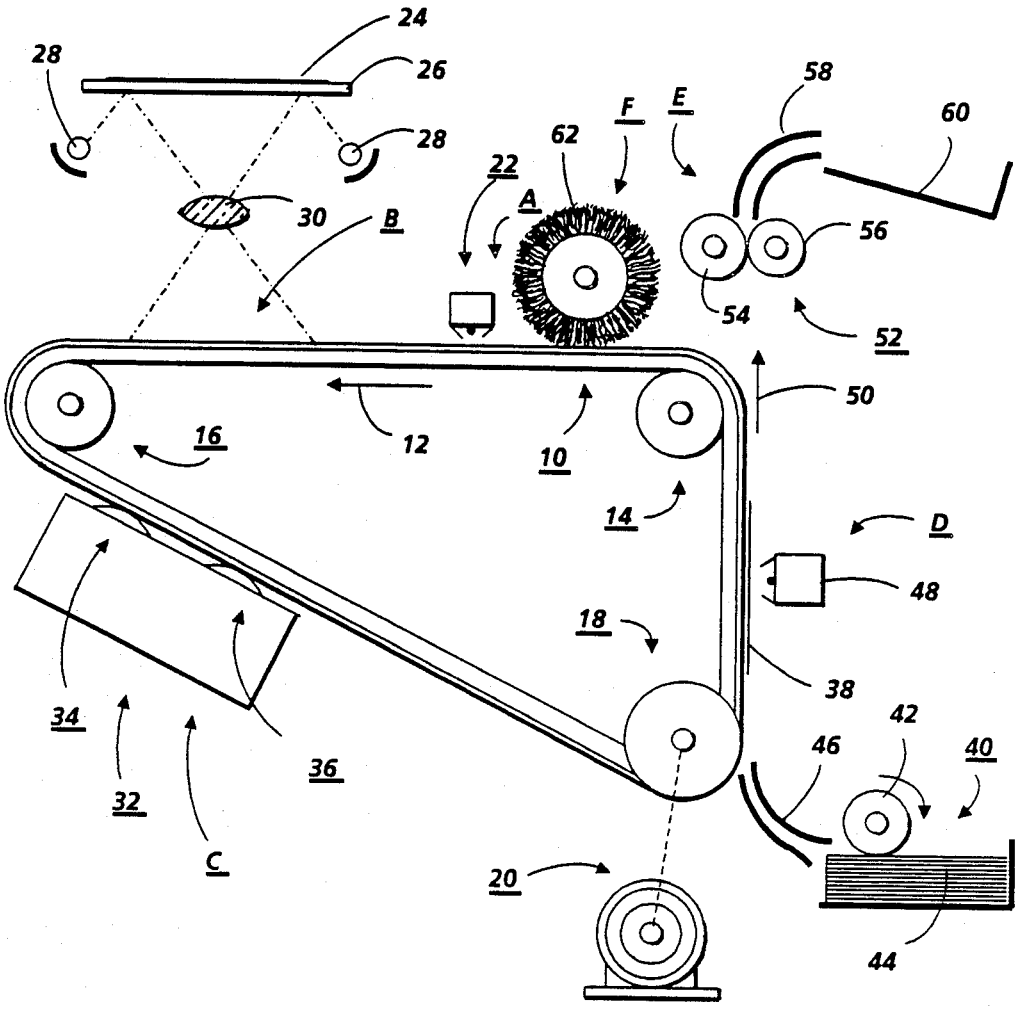
FIG. 1 is a schematic elevational view depicting an illustrative electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this apparatus is equally well suited for use in a wide variety of electrostatographic printing machines.

Inasmuch as the art of electrophotographic printing is well known, the various processing stations employed in the FIG. 1 printing machine will be shown hereinafter schematically and their operation described with reference thereto.

Turning now to FIG. 1, the electrophotographic printing machine employs a photoconductive belt 10 made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generator layer is made from trigonal selenium. The ground layer is made from a titanium coated Mylar. The ground layer is very thin and allows light to pass therethrough. Other suitable photoconductive materials, ground layers, and anti-curl backing layers may also be employed.

Belt 10 moves in the direction of arrow 12 to advance successive portions of the photoconductive surface of belt 10 through the various stations disposed about the path of movement thereof. As shown, belt 10 is entrained about stripping roller 14, tensioning roller 16 and drive roller 18. Drive roller 18 is mounted rotatably and in engagement with belt 10. Motor 20 rotates roller 18 to advance belt 10 in the direction of arrow 12. Roller 18 is coupled to motor 20 by suitable means, such as a drive belt. Stripper roller 16 and tension roller 18 are mounted to be freely rotatable.

Initially, a portion of belt 10 passes through charging station A. At charging station A, a corona generating device, indicated generally by the reference numeral 22, charges a portion of the photoconductive surface of belt 10 to a relatively high, substantially uniform potential.

Next, the charged portion of the photoconductive surface is advanced through exposure station B. At exposure station B, an original document 24 is positioned face down upon a transparent platen 26. Lamps 28 flash light rays onto original document 24. The light rays reflected from original document 24 are transmitted through lens 30 forming a light image thereof. Lens 30 focuses the light image onto the charged portion of the photoconductive surface to selectively dissipate the charge thereon. This records an electrostatic latent image on the photoconductive surface which corresponds to the informational areas contained within original document 24 disposed upon transparent platen 26. After the electrostatic latent image has been recorded on the photoconductive surface, belt 10 advances the electrostatic latent image to development station C.

At development station C, a magnetic brush development system, indicated generally by the reference numeral 32, transports a developer mixture of carrier granules and toner particles into contact with the electrostatic latent image recorded on the photoconductive surface. Magnetic brush development system 32 includes two developer units, indicated generally by the reference numerals 34 and 36, respectively. Magnetic brush development system 32 will be described hereinafter in greater detail with reference to FIG. 2.

With continued reference to FIG. 1, after development, belt 10 advances the toner powder image to transfer station D. At transfer station D, a sheet of support material 38 is moved into contact with the toner powder image. Support material 38 is advanced to transfer numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D.

Transfer station D includes a corona generating device 48 which sprays ions onto the back side of sheet 38. This attracts the toner powder image from the photoconductive surface to sheet 38. After transfer, the sheet continues to move in the direction of arrow 50 onto a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38. After fusing, chute 58 guides the advancing sheet to catch tray 60 for subsequent removal from the printing machine by the operator.

Invariably, after the sheet of support material is separated from the photoconductive surface of belt 10, some residual toner particles remain adhering thereto. These residual particles are removed from the photoconductive surface at cleaning station F. Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 in contact therewith. Subsequent to cleaning, a discharge lamp (not shown) floods the photoconductive surface with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 2:
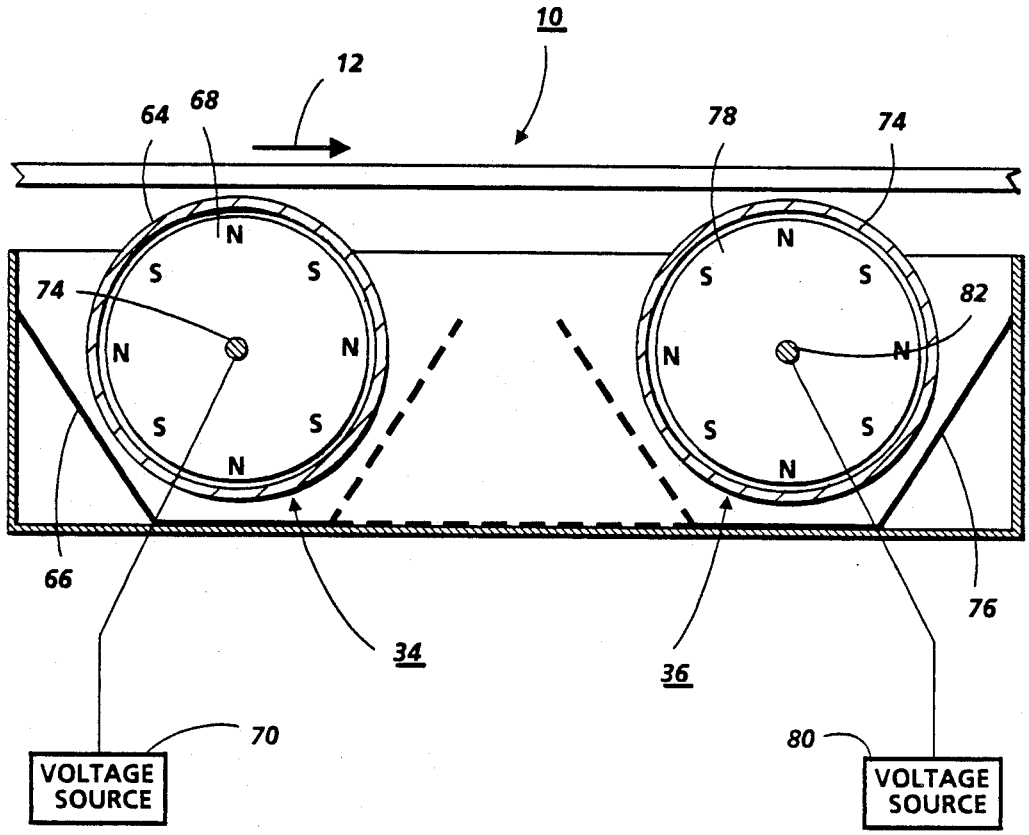
FIG. 2 is a schematic elevational view showing the development apparatus of the FIG. 1 printing machine in greater detail.

Referring now to FIG. 2, there is shown the details of magnetic brush development system 32. As shown thereat, magnetic brush development system 32 includes a first developer unit 34 positioned before a second developer unit 36 in the direction of movement of belt 10, as indicated by arrow 12. Developer unit 34 includes a tubular member or sleeve 64 mounted rotatably on the frame of housing 66. An elongated magnet 68 is disposed interiorly of sleeve 64 to attract developer material in housing 66 to the sleeve. By way of example, the elongated magnetic member 68 is cylindrical and preferably made from barium ferrite having a plurality of magnetic poles impressed about the circumferential surface thereof. The tubular member 64 is made preferably from aluminum having the exterior circumferential surface thereof roughened. As the tubular member 64 rotates, the magnetic member 68 attracts developer material thereto forming a brush of carrier granules and toner particles. The toner particles are attracted from the carrier granules to the electrostatic latent image forming a toner powder image on the photoconductive surface of belt 10. A voltage source 70 is connected to shaft 72 supporting sleeve 64 so as to electrically bias sleeve 64 to a preselected voltage level. Developer unit 36 includes a tubular member or sleeve 74 mounted rotatably on the frame of housing 76. An elongated magnet 78 is disposed interiorly of sleeve 74 to attract developer material in housing 76 to the sleeve. By way of example, the elongated magnetic member 78 is cylindrical and preferably made from barium ferrite having a plurality of magnetic poles impressed about the circumferential surface thereof. The tubular member 74 is made preferably from aluminum having the exterior circumferential surface thereof roughened. As the tubular member 74 rotates, the magnetic member 78 attracts developer material thereto forming a brush of carrier granules and toner particles. The toner particles are attracted from the carrier granules to the electrostatic latent image forming a toner powder image on the photoconductive surface of belt 10. A voltage source 80 is connected to shaft 82 supporting sleeve 74 so as to electrically bias sleeve 74 to a preselected voltage level. The voltage level of the electrical bias applied on sleeve 64 is greater than the voltage level electrically biasing sleeve 78. The selection of the appropriate electrical biases on sleeves 64 and 74, respectively, are factors in insuring that development system 32 operates in a piecewise fashion so that the density of the developer material deposited on the latent image by developer units 34 and 36 approximates that of the original document over a second density region of the original document, and that the density of the developer material deposited on the latent image by developer unit 36 approximates that of the original document over a first density region. One skilled in the art will appreciate that while two voltage sources have been described, one voltage source may be employed. When one voltage source is used, it is connected to the respective sleeves through suitable electrical circuits to achieve the desired electrical biases on the respective sleeves. The developer material being transported by the developer unit 34 has the same triboelectrical characteristics as the developer material being transported by developer unit 36. The developability coefficient of developer unit 34 is greater than the developability coefficient of developer unit 36. However, one skilled in the art will appreciate that different developer materials may be used in each developer unit and the triboelectrical characteristics of the developer material may be different for each developer unit, and the developability coefficients for each developer unit may vary.

Development system 32 is designed to linearize the ratio of the density of the original document to the density of the copy. This is achieved by using two sequential developer units 34 and 36. To achieve linearization, the solid area development characteristics of these developer units should provide for linear development of mass versus photoreceptor input voltage. Development should cutoff when the photoreceptor input voltage is less than the voltage level of the electrical bias applied on the respective sleeves of the developer units. Development from developer unit 36 must not disturb or scavenge the toner powder image developed on the photoconductive surface by developer unit 34. All references to more or less voltage refers to a positive charging photoreceptor systems. The voltages are all reversed in a negative charging photoreceptor system.

The linear mass developabilities for the individual developer units 34 and 36 with developability coefficients $N_a$ and $N_b$, which have to be determined, may be expressed as:

$$\text{Mass}_a = N_a(V_{p/r\text{-}a\ input} - V_{bias\text{-}a})/T_a, \text{ if } V_{p/r\text{-}a} \text{ input} > V_{bias\text{-}a}$$

$$\text{Mass}_a = 0, \text{ if } V_{p/r\text{-}a\ input} < V_{bias\text{-}a}$$

$$\text{Mass}_b = N_b(V_{p/r\text{-}b\ input} - V_{bias\text{-}b})/T_b, \text{ if } V_{p/r\text{-}b\ input} > V_{bias\text{-}b}$$

$$\text{Mass}_b = 0, \text{ if } V_{p/r\text{-}b\ input} < V_{bias\text{-}b}$$

where $N_a$ and $N_b$ are dimensionless parameters which vary from 0 to 1 and where a value of 1 corresponds to development which completely neutralizes the photoreceptor voltage. $V_{p/r\text{-}a\ input}$ is the voltage of the photoconductive surface or photoreceptor entering development unit 34, and $V_{p/r\text{-}b\ input}$ is the voltage of the photoconductive surface or photoreceptor entering development unit 36. $\text{Mass}_a$ is the mass deposited by developer unit 34 on the photoreceptor. $\text{Mass}_b$ is the mass deposited by developer unit 36 on the photoreceptor. $T_a$ is proportional to the triboelectric charge per mass of the developer material in developer unit 34 and to the photoreceptor dielectric thickness and toner related geometry related parameters. $T_b$ is the corresponding parameter for the developer material in developer unit 36.

The photoreceptor voltage after the first developer unit 34 may be expressed as:

$$V_{p/r\text{-}a\ out} = V_{p/r\ b\ input} = V_{p/r\ a\ input} - N_a(V_{p/r\text{-}a\ input} - V_{bias\text{-}a}),$$

$$\text{if } V_{p/r\text{-}a\ input} > V_{bias\text{-}a}$$

$$V_{p/r\text{-}a\ output} = V_{p/r\text{-}b\ input} = V_{p/r\ a\ input}, \text{ if } V_{p/r\text{-}a\ input} < V_{bias\text{-}a}$$

Hence, the total mass, the sum of $\text{Mass}_a$ and $\text{Mass}_b$ may be expressed as:

$$\text{Mass Total} = \{[N_a/T_a - N_bN_a/T_b](V_{p/r} - V_{bias\text{-}a}) + N_a/T_b(V_{p/r} - V_{bias\text{-}b})\}$$

$$\text{if } V_{p/r} > V_{bias\text{-}a}$$

$$\text{Mass Total} = N_b/T_b(V_{p/r} - V_{bias\text{-}b})$$

$$\text{if } V_{bias\text{-}b} < V_{p/r} < V_{bias\text{-}a}$$

where $V_{p/r}$ is the voltage on the photoconductive surface or photoreceptor.

Here, there are three attributes for each developer unit, the developability coefficient, N, the bias voltage, $V_{bias}$, and the developed charge to mass ratio, i.e. the triboelectric charge, T.

In order to linearize the ratio of the original document input density to copy output density, the highly non-linear characteristics of the electrophotographic printing process must be compensated for before and after development.

Before development, the voltage on the photoreceptor may be expressed as the function F:

$$V_{p/r-a} = F(F_{in}, \text{charge, exposure, etc.})$$

After development, the output density of the copy may be expressed as the function G:

$$D_{out} = G(Mass_a + \text{Mass}_b, \text{fuser gloss, etc.})$$

An example of an analytical description of the before development characteristics is the "Levy" law:

$$F = V_{p/r-a} = [(1-10^{-Din})V_0^{\frac{1}{2}} + 10^{-Din}(V_{bg})^{\frac{1}{2}}]2$$

where $V_{bg} = V_{p/r}(D_{in}=0)$ and $V_0 = V_{p/r}(D_{in} = \text{infinity})$ A typical after development analytic descriptive model is:

$$G = D_{out} = -2\log_{10}(1-[1-10^{-D_{max}/2})]\{1-e^{-k.Mass}\})$$

where $D_{max}$ = output density of the copy at infinite mass and k is an empirical parameter.

Thus, an empirical or model characterization of the total system may be expressed as:

$$D_{out} = G[Mass\{V_{p/r} = F[D_{in}. \ldots], N_a, N_b, V_{bias-a}, V_{bias-b}, T_a, T_b\}, \ldots]$$

Given this relationship, the development parameters $N_a$, $N_b$, $V_{bias\text{-}a}$, $V_{bias\text{-}b}$, $T_a$, and $T_b$ may be varied to achieve the most linear $D_{in}$ versus $D_{out}$ relationship feasible.

Figure 3:
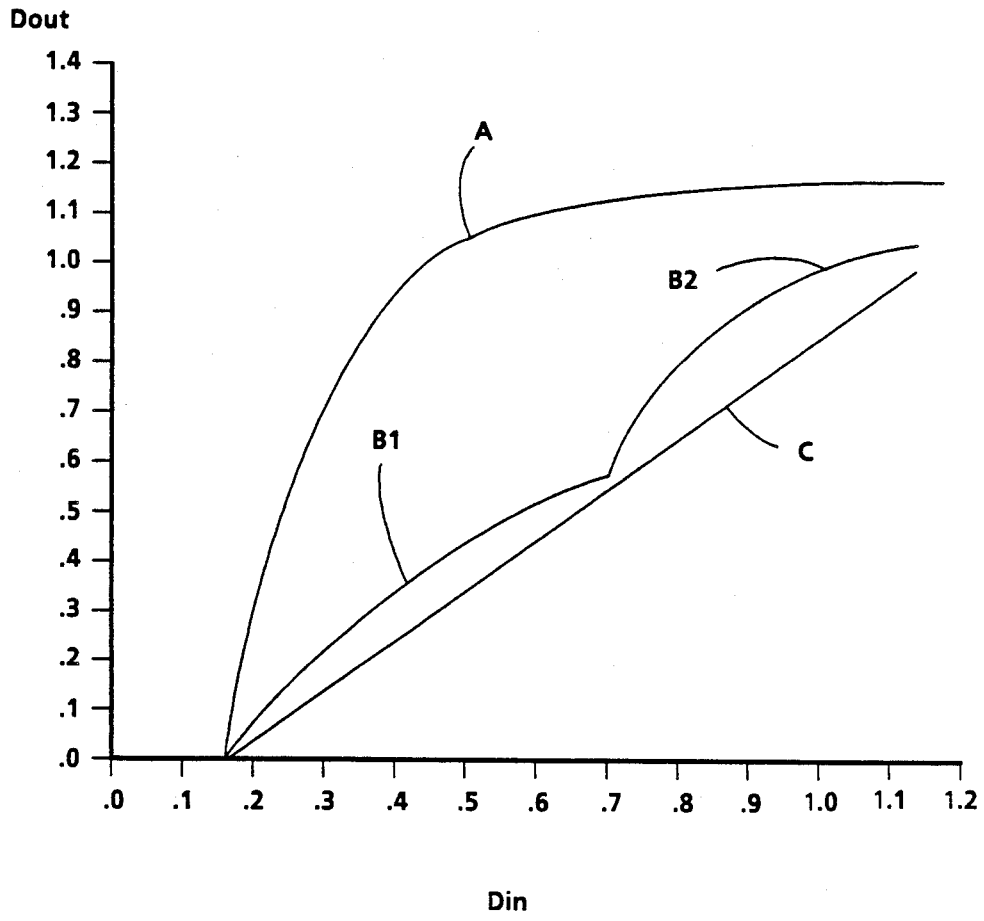
FIG. 3 is a graph showing a plot the density of the original document versus the copy for a conventional development apparatus and the FIG. 2 development apparatus.

Referring now to FIG. 3, there is shown curve A for a typical development system illustrating the variation of $D_{out}$ as a function of $D_{in}$.

The development system parameters for curve A are the following:

$N_a = 0$
$N_b = 0.28$
$V_{bias\text{-}b} = 240$ volts

Here, only one developer material is used and only one or one set of developer units, all having the same electrical bias, is employed. As shown, curve A is highly non-linear, being concave. Alternatively, if the two developer units of the present invention are employed, the characteristics of the development system may be regulated to produce a curve B which approximates the linear relationship shown by curve C. Curve B is characteristic of a piecewise development system. Developer unit 36 produces the curve B1 alone while developer units 34 and 36 combine to produce the curve B2. The curve B was produced by the development system 32 with the developer units having the following characteristics:

$N_a = 0.390$
$N_b = 0.075$
$V_{bias-b} = 240$ volts
$V_{bias-a} = 650$ volts $T_a = T_b = T$, developer unit 34 and developer unit 36 use the same developer material which have the same triboelectric charge, T.

Figure 4:
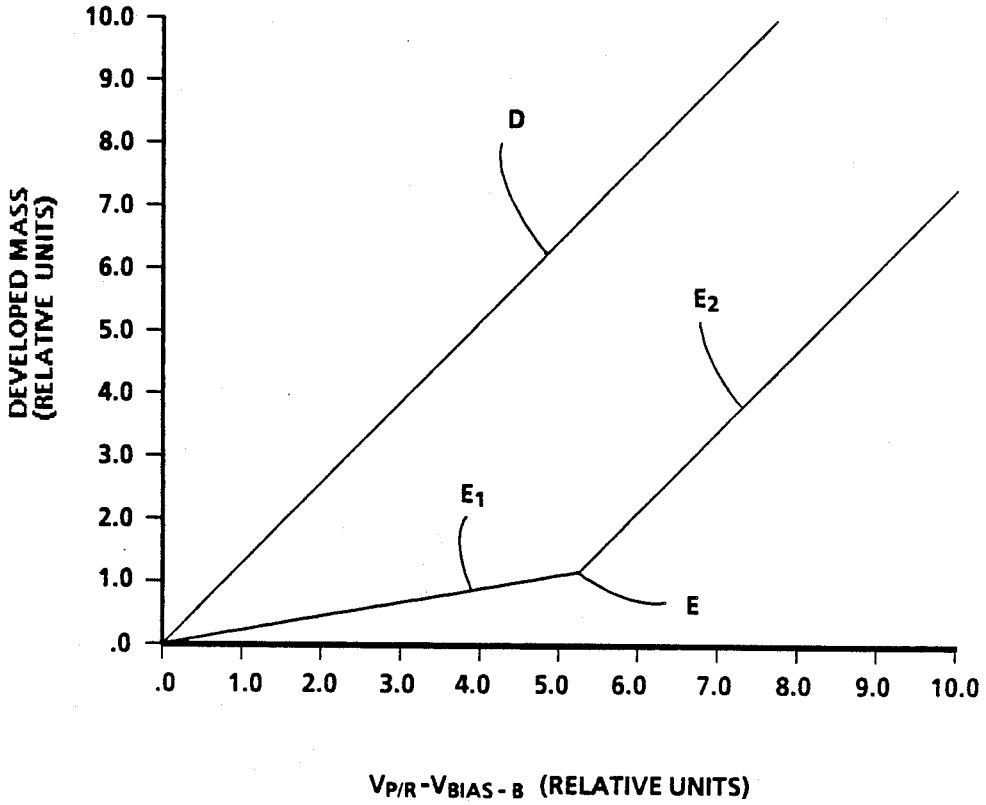
FIG. 4 is a graph illustrating a plot of the developed mass versus the bias voltage on the developer unit for the conventional development apparatus and the FIG. 2 development apparatus.

$k/T = 0.036$ volts$^{-1}$
$V_0 = 850$ volts
$V_{bg} = 90$ volts
$D_{max} = 1.25$ Turning now to FIG. 4, there is shown curve D which illustrates the curve for a normal development system showing that the developed mass versus image potential is linear. All systems generally have this type of curve, or worse yet, a concave down mass versus image potential curve. Curve E represents a piecewise development system where E1 represents the characteristics of developer unit 36 and curve E2 that of developer units 34 and 36. The electrical bias of developer unit 36 is set at the normal electrical bias and the electrical bias of developer unit 34 is set much higher, at the desired breakpoint in the development curve. Thus, when the latent image passes through developer unit 34, if the image potential is below the breakpoint, a cleaning field is present and there will be no development. The latent image then progresses to developer unit 36 and will be developed. The resulting development curve will be similar to curve E1. Alternatively, if the latent image has a potential over the breakpoint, the latent image will be developed by both developer units 34 and 6. The resulting developability and mass deposition will be higher and will produce a development curve similar to curve E2.

One skilled in the art will appreciate that while only two developer units have been described to achieve piecewise development, any number of developer units, i.e. two or more developer units, may be used. In addition, each of the developer units may have any number of developer rollers, i.e. one or more developer rollers, which, for each developer unit, are electrically biased to the same voltage level. Furthermore, one developer unit may be used having more than one developer roller where each of the developer rollers are electrically biased to different voltage levels to achieve piecewise development so that the output density of the copy is substantially the same as the density of the original document. Moreover, different types of developer materials may be used. For example, single component developer material, as well as liquid developer materials may be used.

In recapitulation, it is clear that the development apparatus of the present invention linearizes the copy density output with respect to the density of the original document. This is achieved by using two developer units operating in a piecewise fashion. Thus, one developer unit develops the latent image over one region and both or the other developer unit develop the latent image over another region. The regions may have overlapping portions. In this way, the density of the developer materials deposited on the latent image by one of the developer units approximates that of the original document over one region and the density of the developer material deposited on the latent image by both or the other one of the developer units approximates that of the original document over another region. The resultant density of the copy is substantially the same as that of the original document.

It is, therefore, evident that there has been provided, in accordance with the present invention, an apparatus for developing a latent image that fully satisfies the aims and advantages hereinbefore set forth. While this invention has been described in conjunction with a specific embodiment thereof, it is evident that many alternatives, modifications and variations will become apparent to those skilled in the art. Accordingly, it is intended to embrace all such alternatives, modifications and variations as fall within the spirit and broad scope of the appended claims.

I claim:

1. An apparatus for developing a latent image, corresponding to an original document, recorded on a moving member, including:

a first developer unit positioned closely adjacent the member for transporting developer material to the latent image;

a second developer unit positioned closely adjacent the member, after said first developer unit in the direction of movement of the member, for transporting developer material to the latent image; and means for regulating the characteristics of said first developer unit and said second developer unit so that the density of the developer material deposited on the latent image by said second developer unit approximates that of the original document over a first density region of the original document and that the density of the developer material deposited on the latent image by said first developer unit or said first developer unit and said second developer unit approximates that of the original document over a second density region.

2. An apparatus according to claim 1, wherein said regulating means includes means for electrically biasing said first developer unit to a first voltage level and said second developer unit to a second voltage level with the first voltage level having a magnitude greater than the magnitude of the second voltage level.

3. An apparatus according to claim 2, wherein the developer material being transported by said first developer unit has the same triboelectrical characteristics as the developer material being transported by said second developer unit.

4. An apparatus according to claim 2, wherein said first developer unit has a first developability coefficient and said second developer unit has a second developability coefficient with the first developability coefficient being greater than the second developability coefficient.

5. An apparatus according to claim 2, wherein said first developer unit includes:

a housing storing a supply of developer material therein; and a first developer roller disposed at least partially in said housing and adapted to attract developer material thereto.

6. An apparatus according to claim 5, wherein said second developer unit includes a second developer roller disposed at least partially in said housing and adapted to attract developer material thereto.

7. An apparatus according to claim 6, wherein said first developer roll includes:

a first tubular member journalled for rotation; and a first elongated magnetic member disposed interiorly of said first tubular member.

8. An apparatus according to claim 7, wherein said second developer roller includes:

a second tubular member journalled for rotation; and a second elongated magnetic member disposed interiorly of said second tubular member.

9. An apparatus according to claim 8, wherein said electrical biasing means includes a first voltage source coupled to said first tubular member to electrically bias said first tubular member to the first voltage level.

10. An apparatus according to claim 9, wherein said electrical biasing means includes a second voltage source coupled to said second tubular member to electrically bias said second tubular member to the second voltage level.

11. An electrophotographic printing machine of the type in which an electrostatic latent, corresponding to an original document, is recorded on a moving photoconductive member, wherein the improvement includes:

a first developer unit positioned closely adjacent the photoconductive member for transporting developer material to the electrostatic latent image;

a second developer unit positioned closely adjacent the photoconductive member, after said first developer unit in the direction of movement of the photoconductive member, for transporting developer material to the electrostatic latent image; and means for regulating the characteristics of said first developer unit and said second developer unit so that the density of the developer material deposited on the latent image by said second developer unit approximates that of the original document over a first density region of the original document and that the density of the developer material deposited on the latent image by said second developer unit or both said first developer unit and said second developer unit approximates that of the original document over a second density region.

12. A printing machine according to claim 11, wherein said regulating means includes means for electrically biasing said first developer unit to a first voltage level and said second developer unit to a second voltage level with the first voltage level having a magnitude greater than the magnitude of the second voltage level.

13. A printing machine according to claim 12, wherein the developer material being transported by said first developer unit has the same triboelectrical characteristics as the developer material being transported by said second developer unit.

14. A printing machine according to claim 12, wherein said first developer unit has a first developability coefficient and said second developer unit has a second developability coefficient with the first developability coefficient being greater than the second developability coefficient.

15. A printing machine according to claim 12, wherein said first developer unit includes:

a housing storing a supply of developer material therein; and a first developer roller disposed at least partially in said housing and adapted to attract developer material thereto.

16. A printing machine according to claim 15, wherein said second developer unit includes a second developer roller disposed at least partially in said housing and adapted to attract developer material thereto.

17. A printing machine according to claim 16, wherein said first developer roller includes:

a first tubular member journalled for rotation; and a first elongated magnetic member disposed interiorly of said first tubular member.

18. A printing machine according to claim 17, therein said second developer roller includes:

a second tubular member journalled for rotation; and a second elongated magnetic member disposed interiorly of said second tubular member.

19. A printing machine according to claim 18, wherein said electrical biasing means includes a first voltage source coupled to said first tubular member to electrically bias said first tubular member to the first voltage level.

20. A printing machine according to claim 19, wherein said electrical biasing means includes a second voltage source coupled to said second tubular member to electrically bias said second tubular member to the second voltage level.

* * * * *